US006053421A

United States Patent [19]

Chockley

[11] Patent Number: 6,053,421

[45] Date of Patent: Apr. 25, 2000

[54] HYDRAULICALLY-ACTUATED FUEL INJECTOR WITH RATE SHAPING SPOOL CONTROL VALVE

[75] Inventor: Scott A. Chockley, Shropshire, United Kingdom

[73] Assignee: Caterpillar Inc., Peoria, Ill.

[21] Appl. No.: 09/081,253

[22] Filed: May 19, 1998

[51] Int. Cl.[7] ..... F02M 47/02

[52] U.S. Cl. ..... 239/5; 239/92; 251/129.1; 123/446

[58] Field of Search ..... 239/88–92, 95, 239/96, 124, 127, 533.4, 5; 123/446; 251/129.1

[56] References Cited

U.S. PATENT DOCUMENTS

| | | | |
|---|---|---|---|
| 3,921,604 | 11/1975 | Links | 123/139 |
| 3,943,901 | 3/1976 | Takahashi et al. | 123/139 |
| 3,961,612 | 6/1976 | Okamoto et al. | 123/139 |
| 4,069,800 | 1/1978 | Kanda et al. | 123/139 |
| 4,182,492 | 1/1980 | Albert et al. | 239/92 |
| 4,407,250 | 10/1983 | Eheim et al. | 123/450 |
| 4,459,959 | 7/1984 | Terada et al. | 123/446 |
| 4,612,893 | 9/1986 | Ishibashi et al. | 123/447 |
| 4,640,252 | 2/1987 | Nakamura et al. | 123/446 |
| 4,811,715 | 3/1989 | Djordjevic et al. | 123/447 |
| 5,271,366 | 12/1993 | Shimada et al. | 123/300 |
| 5,460,329 | 10/1995 | Sturman | 239/88 X |
| 5,669,355 | 9/1997 | Gibson | 239/96 X |
| 5,687,693 | 11/1997 | Chen et al. | 123/446 |
| 5,697,342 | 12/1997 | Anderson et al. | 239/96 X |
| 5,709,341 | 1/1998 | Graves | 239/92 |

FOREIGN PATENT DOCUMENTS

| | | | |
|---|---|---|---|
| 0 691 471 | 1/1996 | European Pat. Off. | F02M 47/02 |

*Primary Examiner*—Lesley D. Morris
*Attorney, Agent, or Firm*—Michael McNeil

[57] ABSTRACT

A hydraulically-actuated fuel injector includes an injector body that defines an actuation fluid inlet, a first actuation fluid cavity, a second actuation fluid cavity and a nozzle outlet. A piston is positioned in the injector body and is moveable between a retracted position and an advanced position. The piston has a primary hydraulic surface exposed to fluid in the first actuation fluid cavity, and an opposing hydraulic surface exposed to fluid in the second actuation fluid cavity. A control valve includes a spool valve member that is moveable a distance between a first position and a second position. The first actuation fluid cavity is closed to the actuation fluid inlet when the spool valve member is in its first position. The first actuation fluid cavity is open, but the second actuation fluid cavity is closed, to the actuation fluid inlet when the spool valve member is moving through a first portion of the distance. The first actuation fluid cavity and the second actuation fluid cavity are open to the actuation fluid inlet when the spool valve member is moving through a second portion of the distance. The first actuation fluid cavity is open to the actuation fluid inlet when the spool valve member is in its second position.

20 Claims, 3 Drawing Sheets

HYDRAULICALLY-ACTUATED FUEL INJECTOR WITH RATE SHAPING SPOOL CONTROL VALVE

TECHNICAL FIELD

The present invention relates generally to hydraulically-actuated fuel injectors, and more particularly to a rate shaping spool control valve for a hydraulically-actuated fuel injector.

BACKGROUND ART

Hydraulically-actuated fuel injectors typically use a high pressure fluid acting on a relatively large area intensifier piston to compress fuel under a smaller area plunger. When fuel pressure is raised above a valve opening pressure, a needle check valve lifts to open the nozzle outlet, and fuel commences to spray into the combustion space within an engine. Although fuel could be used as both the hydraulic medium and injection medium, Caterpillar, Inc. of Peoria, Ill. has encountered considerable success by using high pressure engine lubricating oil as the hydraulic medium in its hydraulically-actuated fuel injection systems.

In order to accurately control the timing of each injection event, these fuel injectors typically include a solenoid actuated control valve that opens and closes the fuel injector to a source of high pressure actuation fluid, such as a common rail containing pressurized lubricating oil. Each injection event is initiated by energizing the solenoid to move the control valve to an open position, and each injection event is ended by moving the control valve back to its closed position.

Although these electronically-controlled hydraulically-actuated fuel injectors have de-coupled the injection amount and timing from the operation of the engine, there remains room for improvement, particularly in decreasing noise, particulates and NOx emissions from an engine. In this regard, engineers have observed that undesirable emissions over a significant range of an engine's operation can be decreased if each injection event is rate shaped to include a relatively small pilot flow rate at the beginning of an injection event followed by a relatively large flow rate in the main injection portion.

The present invention is directed to these and other problems associated with producing a particular rate shape trace in a hydraulically-actuated fuel injector.

DISCLOSURE OF THE INVENTION

A hydraulically-actuated fuel injector includes an injector body that defines an actuation fluid inlet, a first actuation fluid cavity, a second actuation fluid cavity and a nozzle outlet. A piston is positioned in the injector body and moveable between a retracted position and an advanced position. The piston has a primary hydraulic surface exposed to fluid in the first actuation fluid cavity, and has an opposing hydraulic surface exposed to fluid in the second actuation fluid cavity. A control valve includes a spool valve member moveable a distance between a first position and a second position. The first actuation fluid cavity is closed to the actuation fluid inlet when the spool valve member is in its first position. The first actuation fluid cavity is open, but the second actuation fluid cavity is closed, to the actuation fluid inlet when the spool valve member is moving through a first portion of the distance between its first and second positions. The first actuation fluid cavity and the second actuation fluid cavity are open to the actuation fluid inlet when the spool valve member is moving through a second portion of the distance. The first actuation fluid cavity is open to the actuation fluid inlet when the spool valve member is in its second position.

BEST MODE FOR CARRYING OUT THE INVENTION

Figure 1:
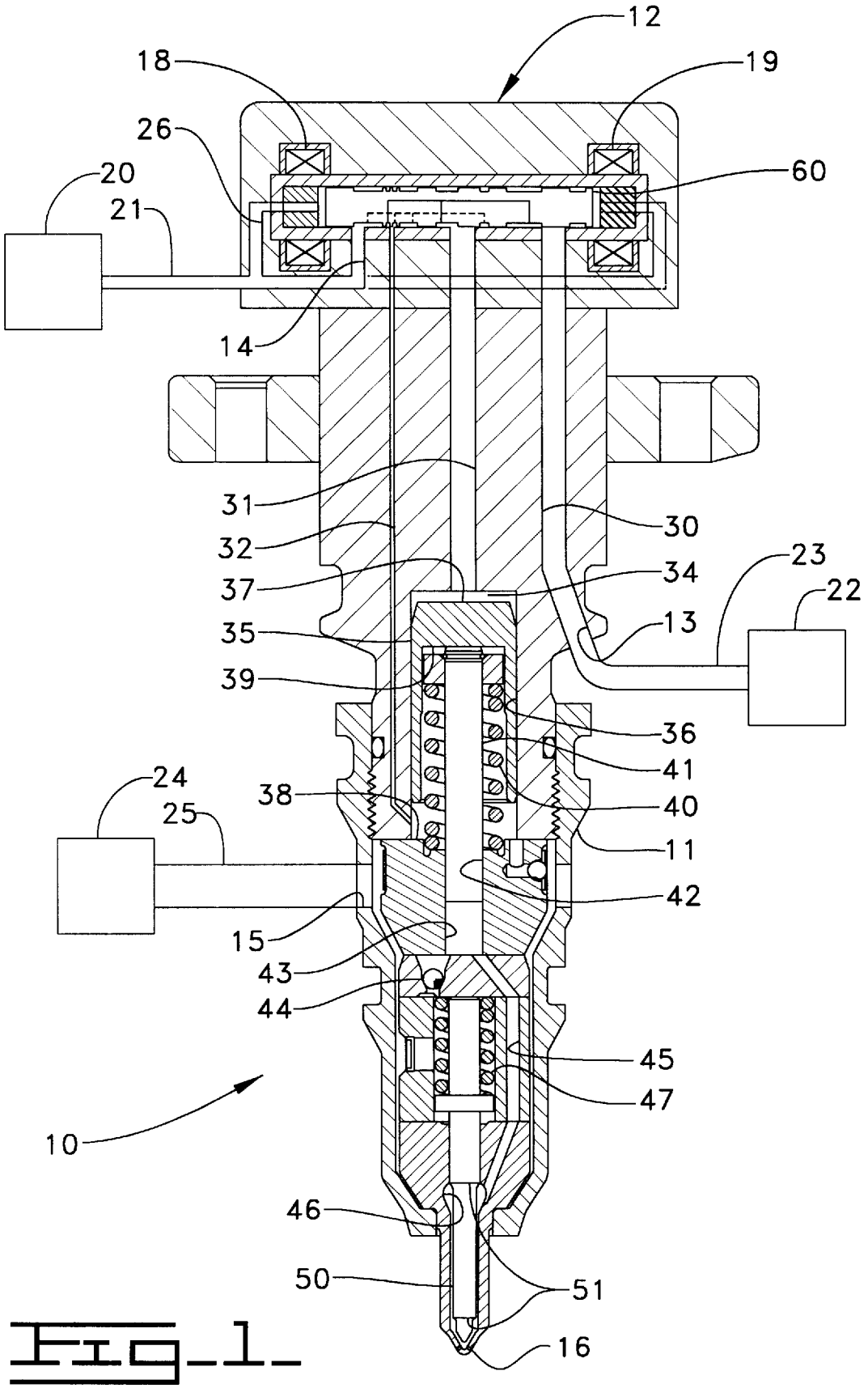
FIG. 1 is a sectioned side diagrammatic view of a hydraulically-actuated fuel injector according to one embodiment of the present invention.

Referring now to FIG. 1, a hydraulically-actuated fuel injector 10 includes an injector body 11 with a solenoid actuated control valve 12 attached thereto. The injector body 11 defines an actuation fluid inlet 13 connected to a source of high pressure actuation fluid 22 via an actuation fluid supply passage 23, and an actuation fluid drain 14 connected to a low pressure return reservoir 20 via a drain passage 21. Reservoir 20 is preferably an engine oil sump at atmospheric pressure, and all drains of the injector could be open under the valve cover. Injector body 11 also defines a fuel inlet 15 connected to a source of fuel fluid 24 via a fuel supply passage 25. Finally, injector body 11 includes a nozzle outlet 16 that is preferably appropriately positioned within the combustion space of an internal combustion engine. In the preferred embodiment, pressurized lubricating oil is used as the hydraulic medium, and distillate diesel fuel is used as the injection medium.

A hydraulic means to pressurize fuel within fuel injector 10 includes an intensifier piston 35 that reciprocates in a piston bore 36 between a retracted position, as shown, and a downward advanced position. Intensifier piston 35 includes an upper or primary hydraulic surface 37 exposed to fluid pressure in a first actuation fluid cavity 34 defined by work passage 31 and a portion of piston bore 36. Intensifier piston 35 also includes an opposing hydraulic surface 39 exposed to fluid pressure in a second actuation fluid cavity 38, which is connected to a control passage 32. Piston 35 is normally biased toward its retracted position, as shown, by a return spring 40. Piston 35 is preferably cylindrically shaped such that hydraulic surfaces 37 and 39 are about equal in area.

The means for pressurizing fuel also includes a plunger 41 that is positioned in a plunger bore 42. Plunger 41 moves with intensifier piston 35 between a retracted position, as shown, and a downward advanced position. A portion of plunger bore 42 and plunger 41 define a fuel pressurization chamber 43 that is fluidly connected to nozzle outlet 16 via a nozzle supply passage 45 and a nozzle chamber 46. When plunger 41 is undergoing its upward return stroke between injection events, fresh fuel is drawn into fuel inlet 15 and into fuel pressurization chamber 43 past a check valve 44. When plunger 41 is undergoing its downward pumping stroke, check valve 44 closes and fuel pressure rises in fuel pressurization chamber 43 and in nozzle chamber 46. A needle valve member 50 is normally in a downward closed position that blocks nozzle chamber 46 to nozzle outlet 16. However, when fuel pressure acting on lifting hydraulic surfaces 51 is sufficient to overcome needle biasing spring 47, needle valve member 50 moves upward to an open position to open nozzle outlet 16.

Figure 4:
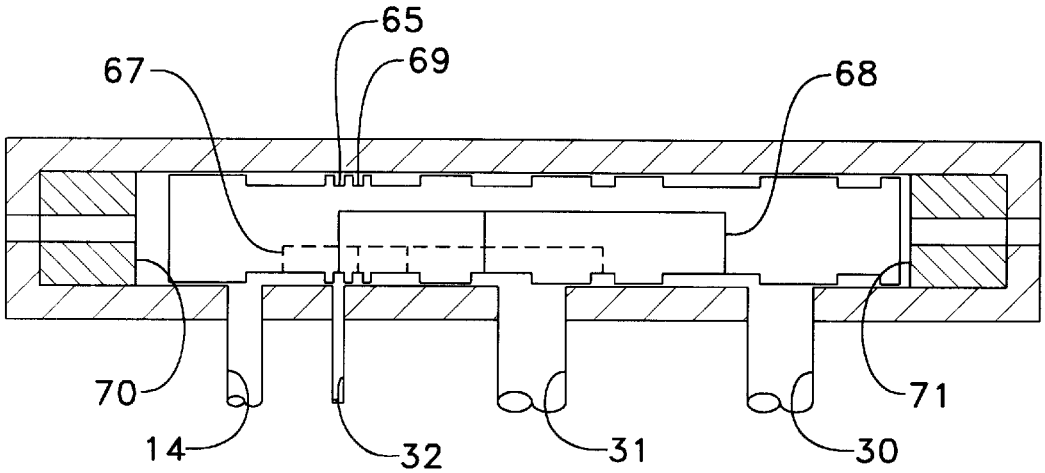
FIG. 4 is a sectioned side diagrammatic view of the spool control valve when moving through a second intermediate position.
Figure 5:
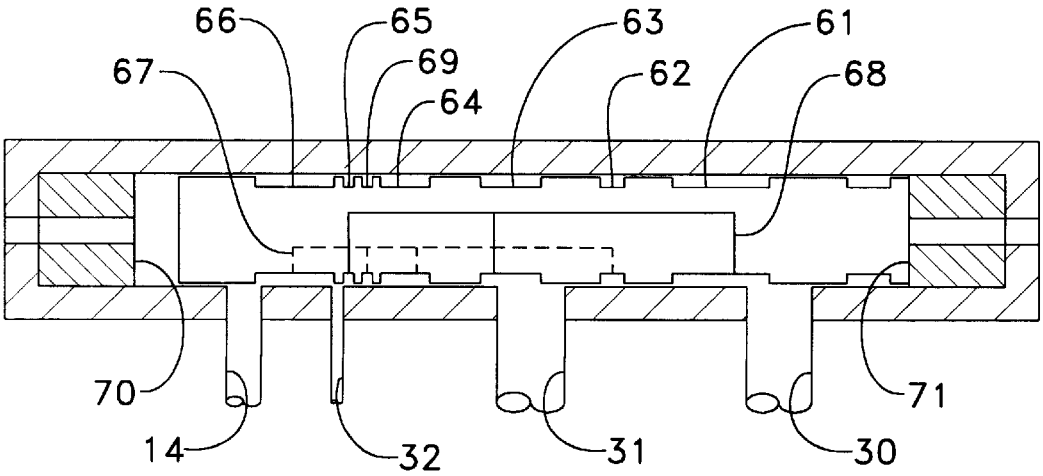
FIG. 5 is a sectioned side diagrammatic view of the spool control valve when in its second stopped position.

Referring now in addition to FIGS. 2–5, solenoid actuated control valve 12 includes first and second opposing solenoids 18 and 19, respectively. Solenoids 18 and 19 are operably coupled to a spool valve member 60, which is capable of moving between a first stop 70 (FIG. 2) and a second stop 71 (FIG. 5). In order to prevent hydraulic locking, the ends of spool valve member 60 are vented to low pressure drain 14 via end drain passages 26 and 67. In this embodiment, spool valve member 60 preferably defines an internal drain passage 67 that is separate and isolated from an internal high pressure passage 68. Spool valve member 60 is preferably hydraulically balanced so that it will stay in one position when neither solenoid 18 nor 19 is energized. Preferably, only one solenoid is energized at any one time.

Figure 2:
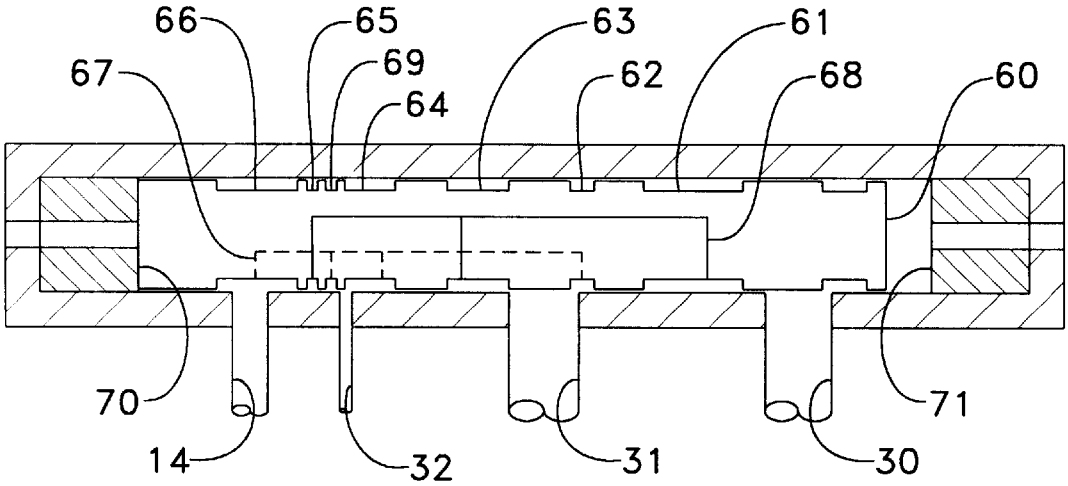
FIG. 2 is a sectioned side diagrammatic view of a spool control valve in its first stopped position according to one aspect of the present invention.
Figure 3:
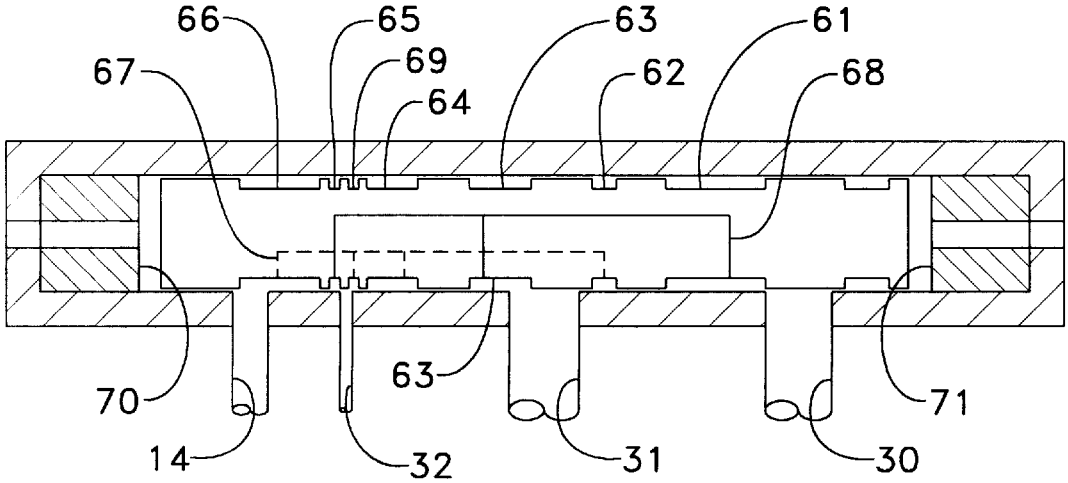
FIG. 3 is a sectioned side diagrammatic view of the control valve of FIG. 2 when moving through a first intermediate position.

Between injection events, spool valve member 60 is positioned in stationary contact with first stop 70 as shown in FIG. 2. When in this position, work passage 31 is connected to actuation fluid drain 14 via drain connection annulus 62, internal drain passage 67 and drain annulus 66. In addition, control passage 32 is connected to work passage 31 and actuation fluid drain 14 via drain control connection annulus 64 and internal drain passage 67. When control valve member 60 is in this position, return spring 40 can push intensifier piston 35 upward to displace fluid from work passage 31 into control passage 32 and actuation fluid drain 14. It is also important to note that when spool valve member 60 is in its first position as shown in FIG. 2, high pressure inlet passage 30, which is connected to actuation fluid inlet 13, is blocked.

When it is time to initiate an injection event, solenoid 19 is energized, and spool valve member 60 begins moving toward the right in the direction of second stop 71. Over a portion of the distance between stop 70 and 71, spool valve member 60 moves through a first intermediate position (FIG. 3) in which high pressure inlet 30 opens to work passage 31 via inlet annulus 61, internal passage 68 and high pressure connection annulus 63. At the same time, drain annulus 69 opens to control passage 32 so that piston 35 can move downward. When high pressure inlet 30 is connected to work passage 31, high pressure actuation fluid acts on primary hydraulic surface 37 of piston 35, and begins moving it and plunger 41 downward to pressurize fuel in fuel pressurization chamber 43. Fuel pressure quickly rises to a level to open needle valve member 50 and commence the spraying of fuel out of nozzle outlet 16.

As spool valve member 60 continues moving to the right, it moves through a second intermediate position in which drain annulus 69 closes and control annulus 65 briefly opens to control passage 32. When this occurs, opposing hydraulic surface 39 on the underside of piston 35 is suddenly exposed to the same high pressure actuation fluid that is acting on its upper hydraulic surface 37. This causes piston 35 to become hydraulically balanced and hesitate in its downward stroke. This in turn causes a brief hesitation in the downward stroke of plunger 41, which causes a brief drop in fuel pressure. Depending upon how control passage 32 and control annulus 65 are sized and arranged, the length of this portion of the injection event can be such that fuel pressure drops low enough for a sufficient amount of time that the needle valve member 50 briefly closes to create a split injection event. Otherwise, the duration can be short enough that the fuel pressure drops but the needle valve member does not completely close so that a boot shaped or step shaped injection event rate trace is created. This second intermediate positioning of spool valve member 60 is shown in FIG. 4.

As spool valve member 60 continues moving to the right, it eventually comes in contact with and stops against stop 71 as shown in FIG. 5. When in this position, control annulus 65 is out of contact with control passage 32, but high pressure inlet 30 continues to be in fluid contact with work passage 31. Control passage 32 reopens to low pressure drain 14 via drain annulus 66. This resumes the flow of high pressure fluid into work passage 31 to continue the downward movement of piston 35 and plunger 41. When this occurs, the main injection event commences. It is also important to note that when spool valve member 60 comes to rest against stop 71, solenoid 19 can be de-energized. Each injection event is ended by energizing solenoid 18 to pull spool valve member 60 back to the position shown in FIG. 2, which closes high pressure inlet 30, and reconnects both work passage 31 and control passage 32 to actuation fluid drain 14.

Industrial Applicability

Those skilled in the art will appreciate that the present invention can be tuned to produce a variety of desirable fuel injection rate traces. For instance, an engineer has a variety of techniques available with which to control the respective durations of the pilot injection event and the time between the pilot and main injection events. For instance, the movement rate of spool valve member 60 can be adjusted by an appropriate sizing of solenoid 19. In addition, the widths and positioning of the various annuluses machined on the outer surface of spool valve member 60 can be adjusted to produce a desired rate shape outcome. Furthermore, different injection rate traces can be created by changing the rate at which spool valve member 60 moves between its stops at different engine operating conditions. For instance, a high current in solenoid 19 could cause spool valve member 60 to move rapidly and create one type of injection rate trace, such as a boot shape. And a lower current to solenoid 19 could cause fuel injector 10 to produce a split injection event.

The above description is intended for illustrative purposes only, and is not intended to limit the scope of the present invention in any way. For instance, another variation of the present invention could include a single solenoid and a spool valve member that is biased in one direction by a compression spring. Thus, various modifications could be made to the illustrated embodiment without departing from the spirit and scope of the present invention, which is defined in terms of the claims set forth below.

I claim:

1. A method of injecting fuel comprising the steps of:

providing a hydraulically actuated fuel injector with an actuation fluid inlet, a spool valve member, and a piston having a primary hydraulic surface exposed to fluid in a first actuation fluid cavity and an opposing hydraulic surface exposed fluid in a second actuation fluid cavity;

moving said spool valve member to a first position in which said first actuation fluid cavity is closed to said actuation fluid inlet;

moving said spool valve member to a second position in which said first actuation fluid cavity is open to said actuation fluid inlet;

moving said spool valve member to a third position in which said first actuation fluid cavity and said second actuation fluid cavity are open to said actuation fluid inlet;

moving said spool valve member to a fourth position in which said first actuation fluid cavity is open to said actuation fluid inlet; and moving said spool valve member back to said first position.

2. The method of claim 1 wherein said fuel injector includes at least one solenoid operably coupled to said spool valve member; and said moving steps are accomplished by selectively energizing said at least one solenoid.

3. The method of claim 1 wherein said spool valve member moves in a single direction when moving sequentially from said first position to said second position, and then to said third position and then to said fourth position.

4. The method of claim 1 wherein said second position and said third position are different portions of a movement distance separating said first position and said fourth position.

5. The method of claim 1 wherein said fuel injector includes an actuation fluid drain;

said first actuation fluid cavity being open to said actuation fluid drain when said spool valve member is in said first position; and said second actuation fluid cavity being open to said actuation fluid drain when said spool valve member is in said second position.

6. The method of claim 5 wherein said first actuation fluid cavity and said second actuation fluid cavity are closed to said actuation fluid drain when said spool valve member is in said third position.

7. A hydraulically actuated fuel injector comprising:

an injector body defining an actuation fluid inlet, a first actuation fluid cavity, a second actuation fluid cavity and a nozzle outlet;

a piston positioned in said injector body and being moveable between a retracted position and an advanced position, and said piston having a primary hydraulic surface exposed to fluid in said first actuation fluid cavity, and further having an opposing hydraulic surface exposed fluid in said second actuation fluid cavity;

a control valve that includes a spool valve member moveable a distance between a first position and a second position;

said first actuation fluid cavity being closed to said actuation fluid inlet when said spool valve member is in said first position;

said first actuation fluid cavity being open, but said second actuation fluid cavity being closed, to said actuation fluid inlet when said spool valve member is moving through a first portion of said distance;

said first actuation fluid cavity and said second actuation fluid cavity being open to said actuation fluid inlet when said spool valve member is moving through a second portion of said distance; and said first actuation fluid cavity being open to said actuation fluid inlet when said spool valve member is in said second position.

8. The hydraulically actuated fuel injector of claim 7 wherein said control valve includes a pair of opposing solenoids operably coupled to said spool valve member.

9. The hydraulically actuated fuel injector of claim 7 wherein said spool valve member is hydraulically balanced.

10. The hydraulically actuated fuel injector of claim 7 wherein said injector body also defines an actuation fluid drain;

said first actuation fluid cavity being open to said actuation fluid drain when said spool valve member is in said first position; and said second actuation fluid cavity being open to said actuation fluid drain when said spool valve member is in said second position.

11. The hydraulically actuated fuel injector of claim 10 wherein said first actuation fluid cavity and said second actuation fluid cavity are closed to said actuation fluid drain when said spool valve member is moving through said second portion of said distance.

12. The hydraulically actuated fuel injector of claim 11 wherein said second actuation fluid cavity is open to said actuation fluid drain when said spool valve member is moving through said first portion of said distance.

13. The hydraulically actuated fuel injector of claim 7 wherein said spool valve member defines at least two separate internal passages.

14. The hydraulically actuated fuel injector of claim 13 wherein said spool valve member has an outer surface defining a plurality of annuluses; and different ones of said plurality of annuluses are fluidly connected by said separate internal passages.

15. A hydraulically actuated fuel injector comprising:

an injector body defining an actuation fluid inlet, an actuation fluid drain, a first actuation fluid cavity, a second actuation fluid cavity and a nozzle outlet;

a piston positioned in said injector body and being moveable between a retracted position and an advanced position, and said piston having a primary hydraulic surface exposed to fluid in said first actuation fluid cavity, and further having an opposing hydraulic surface exposed fluid in said second actuation fluid cavity;

a control valve that includes a spool valve member moveable a distance between a first position and a second position;

said first actuation fluid cavity being closed to said actuation fluid inlet but open to said actuation fluid drain when said spool valve member is in said first position;

said first actuation fluid cavity being open to said actuation fluid inlet, but said second actuation fluid cavity being open to said actuation fluid drain, when said spool valve member is moving through a first portion of said distance;

said first actuation fluid cavity and said second actuation fluid cavity being open to said actuation fluid inlet and closed to said actuation fluid drain when said spool valve member is moving through a second portion of said distance; and said first actuation fluid cavity being open to said actuation fluid inlet, and said second actuation fluid cavity being open to said actuation fluid drain, when said spool valve member is in said second position.

16. The hydraulically actuated fuel injector of claim 15 wherein said spool valve member is hydraulically balanced.

17. The hydraulically actuated fuel injector of claim 16 wherein said spool valve member defines at least two separate internal passages and has an outer surface defining a plurality of annuluses.

18. The hydraulically actuated fuel injector of claim 17 wherein different ones of said plurality of annuluses are fluidly connected by said separate internal passages.

19. The hydraulically actuated fuel injector of claim 18 wherein said injector body defines a fuel inlet connected to source of low pressure fuel fluid; and said actuation fluid inlet is connected to a source of high pressure actuation fluid that is different from said fuel fluid.

20. The hydraulically actuated fuel injector of claim 19 wherein said control valve includes a pair of opposing solenoids operably coupled to said spool valve member.

* * * * *